US008839542B2

(12) United States Patent
Dubois et al.

(10) Patent No.: US 8,839,542 B2
(45) Date of Patent: Sep. 23, 2014

(54) FIREARM HAVING ANTI-PLAY BUFFERS

(75) Inventors: Jason Dubois, North Smithfield, RI (US); John Simon, Springfield, MA (US)

(73) Assignee: Smith & Wesson Corp., Springfield, MA (US)

( * ) Notice: Subject to any disclaimer, the term of this patent is extended or adjusted under 35 U.S.C. 154(b) by 188 days.

(21) Appl. No.: 13/554,568

(22) Filed: Jul. 20, 2012

(65) Prior Publication Data

US 2014/0075802 A1 Mar. 20, 2014

(51) Int. Cl.
*F41A 3/00* (2006.01)
*F41A 11/00* (2006.01)
*F41A 3/66* (2006.01)

(52) U.S. Cl.
CPC .. *F41A 3/66* (2013.01); *F41A 11/00* (2013.01)
USPC ..... 42/16; 42/75.01; 42/75.02; 42/75.04

(58) Field of Classification Search
USPC ..... 42/16, 75.01–75.1
See application file for complete search history.

(56) References Cited

U.S. PATENT DOCUMENTS

| | | | | | |
|---|---|---|---|---|---|
| 241,466 | A | | 5/1881 | Wilson | |
| 289,273 | A | | 11/1883 | Kirkwood | |
| 2,867,931 | A | * | 1/1959 | Schreiber | 42/75.01 |
| 2,941,326 | A | * | 6/1960 | Hamil et al. | 42/75.01 |
| 3,842,527 | A | * | 10/1974 | Low | 42/75.02 |
| 4,290,220 | A | | 9/1981 | Ruger | |
| 4,864,761 | A | | 9/1989 | Gregory | |
| 4,999,939 | A | * | 3/1991 | Reese et al. | 42/40 |
| 5,798,473 | A | * | 8/1998 | Roblyer et al. | 89/14.3 |
| 6,301,817 | B1 | * | 10/2001 | Hogue et al. | 42/71.01 |
| 6,487,805 | B1 | * | 12/2002 | Reynolds | 42/75.03 |
| 6,637,142 | B1 | * | 10/2003 | Reynolds | 42/75.03 |
| 7,587,853 | B2 | * | 9/2009 | Aalto | 42/76.01 |
| 7,900,546 | B2 | | 3/2011 | Bordson | |
| 8,595,970 | B2 | * | 12/2013 | Picciotta et al. | 42/72 |
| 2010/0319232 | A1 | * | 12/2010 | Jamison | 42/75.03 |
| 2011/0185618 | A1 | * | 8/2011 | Jamison et al. | 42/75.03 |
| 2012/0000108 | A1 | * | 1/2012 | Zusman | 42/71.01 |
| 2012/0005930 | A1 | * | 1/2012 | Cragg | 42/1.06 |
| 2012/0151813 | A1 | * | 6/2012 | Brown | 42/73 |
| 2012/0180359 | A1 | * | 7/2012 | Fitzpatrick et al. | 42/71.01 |
| 2012/0204465 | A1 | * | 8/2012 | Hasler | 42/75.03 |
| 2012/0317859 | A1 | * | 12/2012 | Brown | 42/71.01 |
| 2013/0263732 | A1 | * | 10/2013 | Kucynko | 89/191.01 |
| 2013/0276341 | A1 | * | 10/2013 | Wells et al. | 42/71.01 |

FOREIGN PATENT DOCUMENTS

DE 29903804 U1 6/1999

OTHER PUBLICATIONS

ACCU-Wedge. Printed Jul. 31, 2012; UniqueTek.com; http:/www.uniquetek.com/site/696296/product/T1322.

* cited by examiner

*Primary Examiner* — Michelle R Clement
(74) *Attorney, Agent, or Firm* — Ballard Spahr LLP; John A. Chionchio

(57) ABSTRACT

A rifle having a receiver formed of upper and lower receiver portions attached to one another has one or more elastic bodies positioned between facing surfaces of the upper and lower receiver portions. The elastic bodies reduce play or lost motion between the upper and lower receiver portions for improved accuracy.

46 Claims, 7 Drawing Sheets

FIG.1
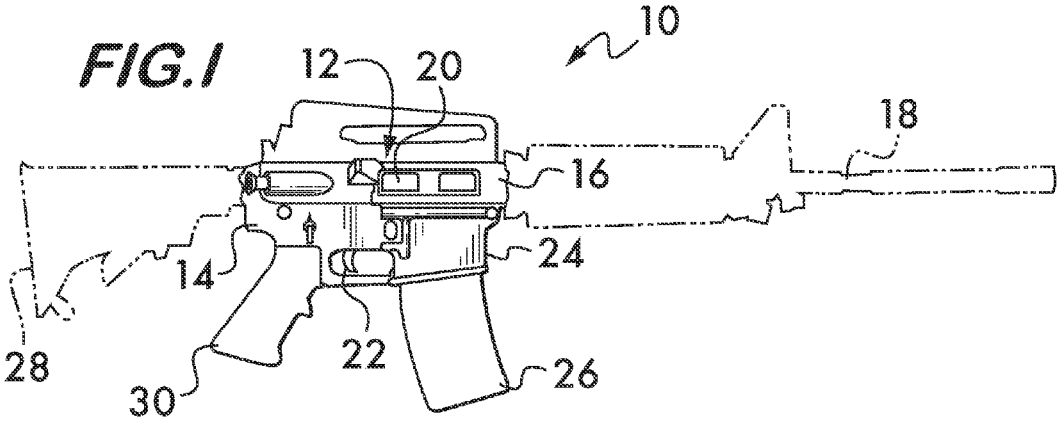
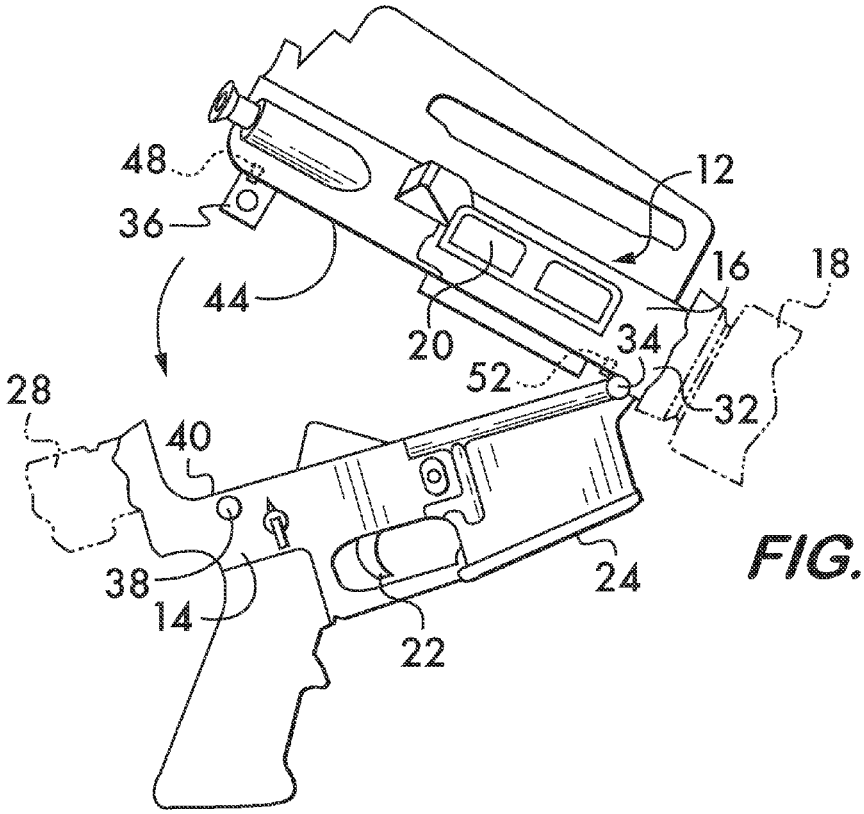
FIG.2

FIG.9
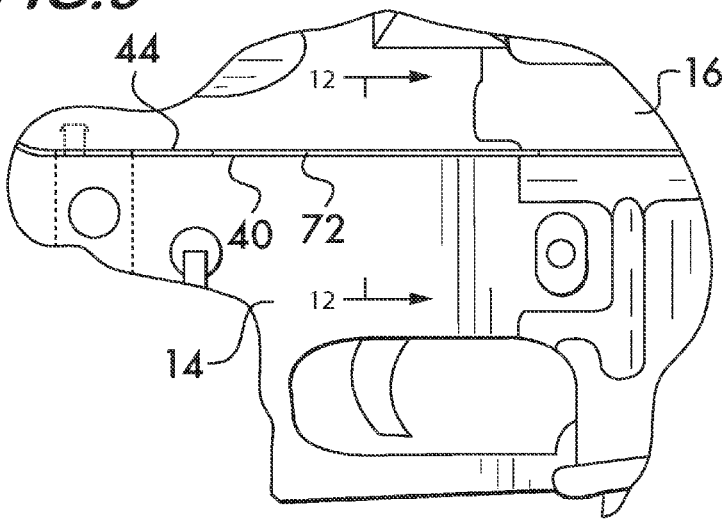
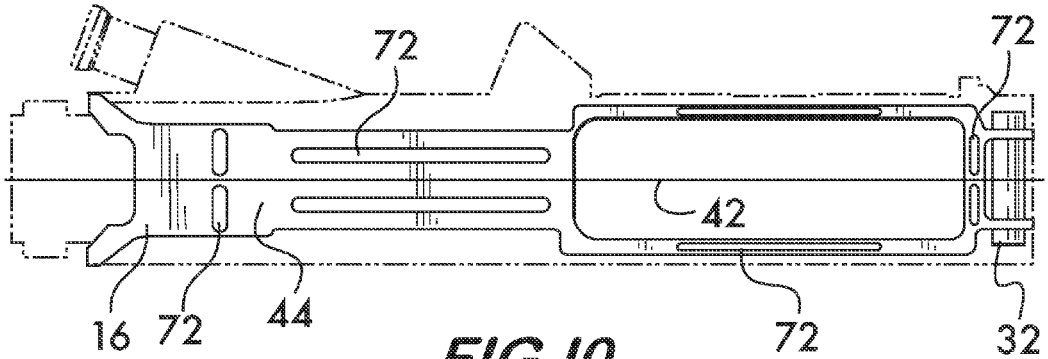
FIG.10

FIG.11
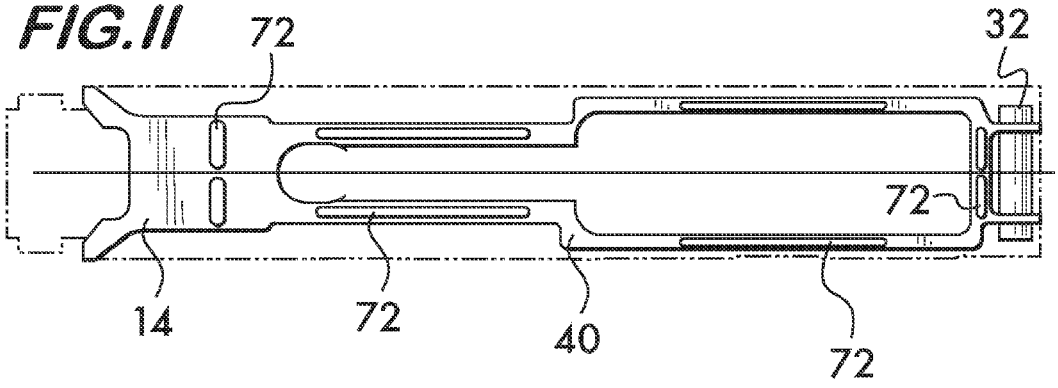
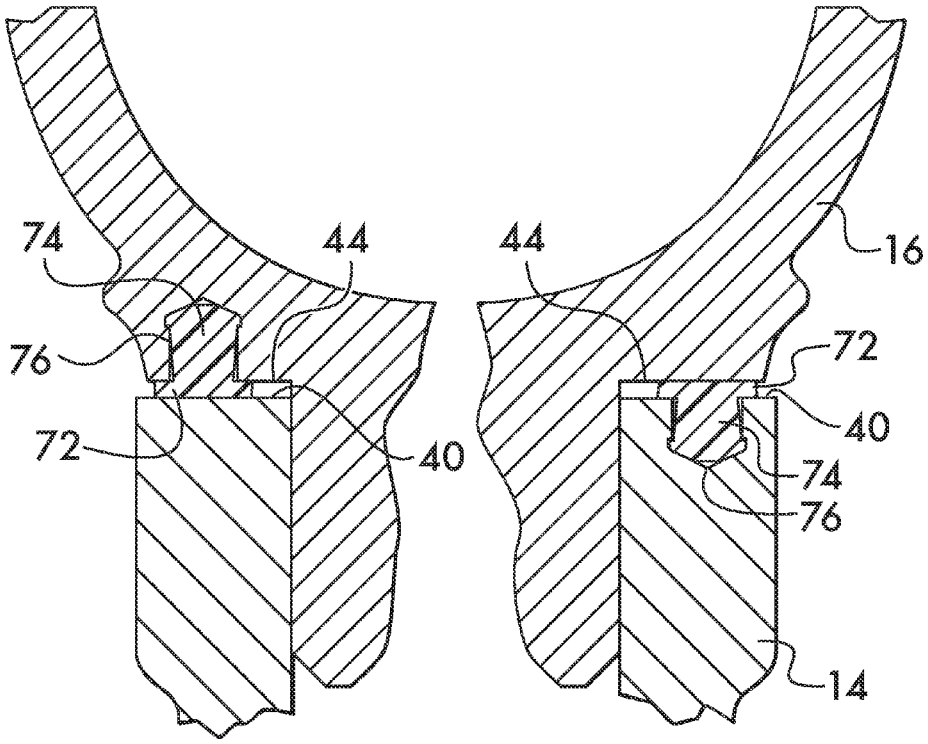
FIG.12

FIREARM HAVING ANTI-PLAY BUFFERS

FIELD OF THE INVENTION

This invention relates to firearms, for example, rifles, and a device for reducing lost motion or play between parts of the firearm.

BACKGROUND

Modern military and sporting rifles may have receiver assemblies formed of upper and lower portions, removably attached to one another to facilitate takedown or field stripping for cleaning. The upper and lower portions may be pivotally connected to one another via a hinge pin located at one end of the receiver assembly, the other ends being secured together by a lug and cross pin combination. While this two part receiver design boasts numerous advantages, one disadvantage occurs when "play", also know as "lost motion" or "lash" is present between the upper and lower receiver assemblies. The play may result from dimensional tolerances between interfacing parts as well as wear between relatively moving parts such as the hinge pin and its bearings or the cross pin and its lug. Both tolerance and wear may result in a fit between the upper and lower receiver portions which is less than tight, allowing relative motion (play) between the two parts. This play can adversely affect the accuracy of the rifle, and may also be perceived as an indication of poor quality of design and/or workmanship. There is clearly a need for a device which can reduce or eliminate play between upper and lower portions of a firearm receiver assembly.

SUMMARY

The invention concerns both a receiver for a firearm and a firearm having a receiver. In one example embodiment, the receiver has a lengthwise extending centerline and comprises a lower receiver portion having a first interface surface extending along opposite sides of the centerline. An upper receiver portion is attached to the lower receiver portion. The upper receiver portion has a second interface surface extending along opposite sides of the centerline. The first and second interface surfaces are in facing relation with one another. A first elastic body is positioned offset from the centerline between the first and second interface surfaces. The first elastic body is engaged with the upper and lower receiver portions when the interface surfaces are in facing relation with one another.

In a particular example embodiment the receiver comprises a second elastic body positioned between the first and second interface surfaces and engaged with the upper and lower receiver portions when the interface surfaces are in facing relation with one another. In certain example embodiments the second elastic body is positioned offset from the centerline and on an opposite side thereof from the first elastic body. The first elastic body may be mounted on the lower receiver portion to project from the first interface surface and engage the second interface surface when the interface surfaces are in facing relation with one another. A second elastic body may also be mounted on the lower receiver portion offset from the centerline to project from the first interface surface and engage the second interface surface when the interface surfaces are in facing relation with one another. In an example embodiment, the first and second elastic bodies comprise pins mounted within respective first and second holes positioned in the first interface surface on opposite sides of the centerline. In a particular example embodiment, at least one of the pins comprises a bulbous head and a conical body attached to the bulbous head. In another example embodiment, the elastic bodies may comprise elongate strips.

The example receiver may comprise a hinge positioned between and pivotally attaching the lower and upper receiver portions to one another. The first and second elastic bodies may be positioned distally to the hinge or proximate to the hinge.

An example receiver may further comprise a third elastic body positioned between the first and second interface surfaces and engaged with the upper and lower receiver portions when the interface surfaces are in facing relation with one another, and a fourth elastic body positioned between the first and second interface surfaces and engaged with the upper and lower receiver portions when the interface surfaces are in facing relation with one another. The third and fourth elastic bodies may be positioned proximate to the hinge. The third and fourth elastic bodies may also be mounted on the lower receiver portion offset from and on opposite sides of the centerline to project from the first interface surface and engage the second interface surface when the interface surfaces are in facing relation with one another. In a particular example embodiment, the third and fourth elastic bodies each have a compressive stiffness greater than a compressive stiffness of the first and second elastic bodies.

In another example receiver embodiment the first elastic body is mounted on the upper receiver portion to project from the second interface surface and engage the first interface surface when the interface surfaces are in facing relation with one another. A second elastic body is mounted on the upper receiver portion offset from the centerline to project from the second interface surface and engage the first interface surface when the interface surfaces are in facing relation with one another. The first and second elastic bodies may comprise pins mounted within respective first and second holes positioned in the second interface surface on opposite sides of the centerline. At least one of the pins comprises a bulbous head and a conical body attached to the bulbous head. In another example embodiment, the elastic bodies may comprise elongate strips.

Another example receiver embodiment comprises a hinge positioned between and pivotally attaching the lower and upper receiver portions to one another. In this embodiment, the first and second elastic bodies may be positioned distally to the hinge or proximate to the hinge.

The example receiver embodiment may further comprise a third elastic body positioned between the first and second interface surfaces and engaged with the upper and lower receiver portions when the interface surfaces are in facing relation with one another. A fourth elastic body may be positioned between the first and second interface surfaces and engaged with the upper and lower receiver portions when the interface surfaces are in facing relation with one another. In this example, the third and fourth elastic bodies may be positioned proximate to the hinge.

In a particular example embodiment, the third and fourth elastic bodies are mounted on the upper receiver portion offset from and on opposite sides of the centerline to project from the second interface surface and engage the first interface surface when the interface surfaces are in facing relation with one another. In this embodiment, the third and fourth elastic bodies may each have a compressive stiffness greater than a compressive stiffness of the first and second elastic bodies.

BRIEF DESCRIPTION OF THE DRAWINGS

FIG. 1 is a side view of an example firearm having a receiver according to the invention;

FIG. 2 is a side view of the firearm shown in FIG. 1 depicting the receiver on an enlarged scale and in an open configuration;

FIG. 9 is a side view of a portion of a receiver of a firearm;

FIG. 10 is a bottom view of an upper receiver portion of a firearm;

FIG. 11 is a top view of a lower receiver portion of a firearm; and

FIG. 12 is a cross sectional view taken at line 12-12 of FIG. 9.

DETAILED DESCRIPTION

Figure 3:
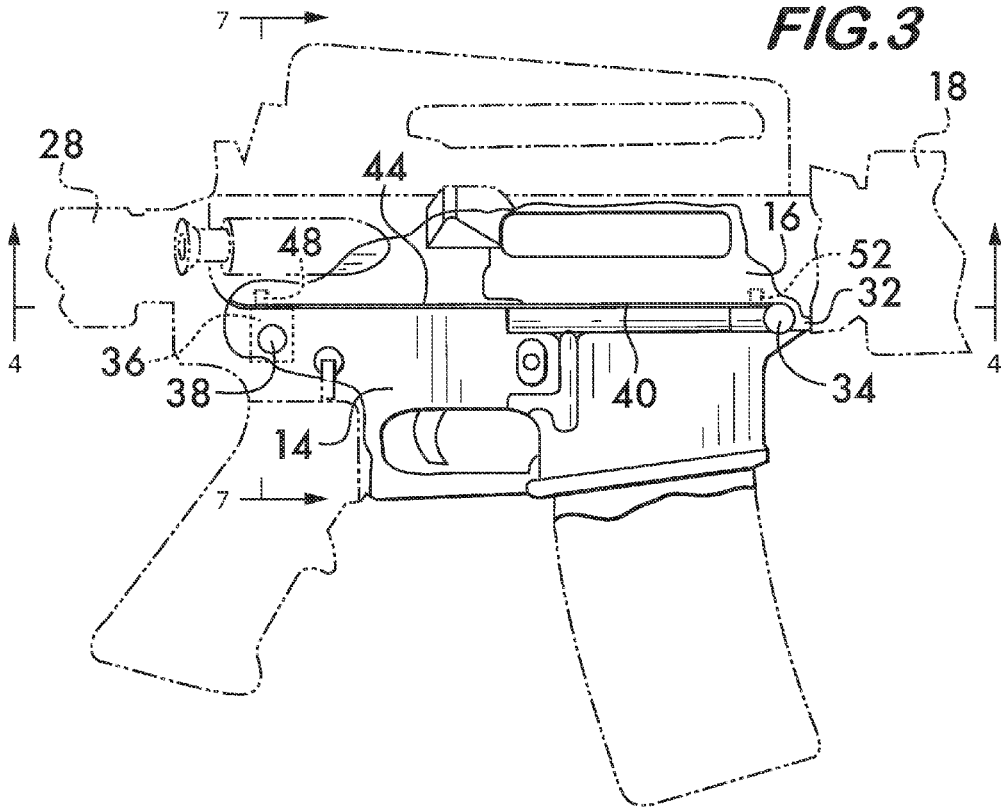
FIG. 3 is a side view of the firearm shown in FIG. 1 depicting the receiver on an enlarged scale and in a closed configuration.

FIG. 1 shows a firearm, in this example, a rifle 10, having a receiver 12 comprised of a lower receiver portion 14 and an upper receiver portion 16. Upper receiver portion 16 may include a barrel 18 and a bolt assembly 20, and the lower receiver portion 14 may include a trigger assembly 22 and a magazine well 24 which receives an ammunition magazine 26. In this example a shoulder stock 28 and a grip 30 are attached to the lower receiver portion 14.

As shown in FIG. 2, the lower and upper receiver portions 14 and 16 are pivotally attached to one another via a hinge 32 positioned at the front of the receiver 12 near the magazine well 24. Hinge 32 has a hinge pin 34 which may be removable to permit complete separation of the receiver portions from one another. A lug 36 and cross pin 38 are positioned at the rear of the receiver 12 near the stock 28. Engagement between the cross pin 38 and lug 36 secures the upper and lower receiver portions to one another. Cross pin 38 is removable to permit relative pivoting motion of the receiver portions as shown in FIG. 2.

Figure 4:
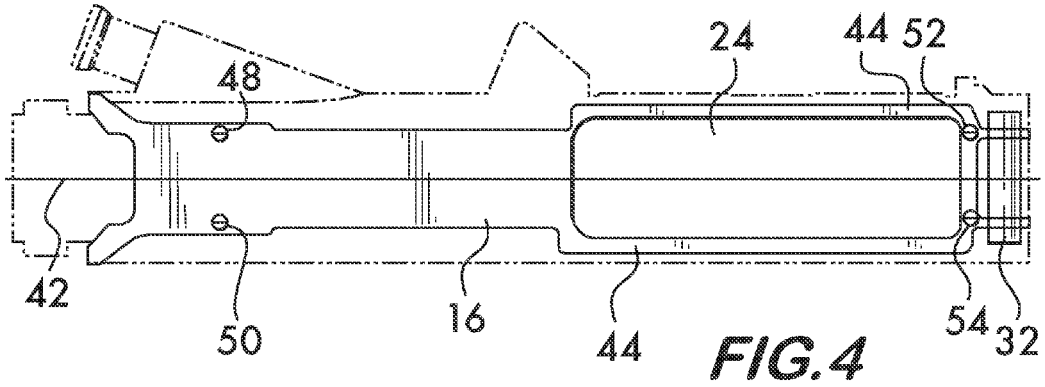
FIG. 4 is a sectional view taken at lines 4-4 in FIG. 3.
Figure 5:
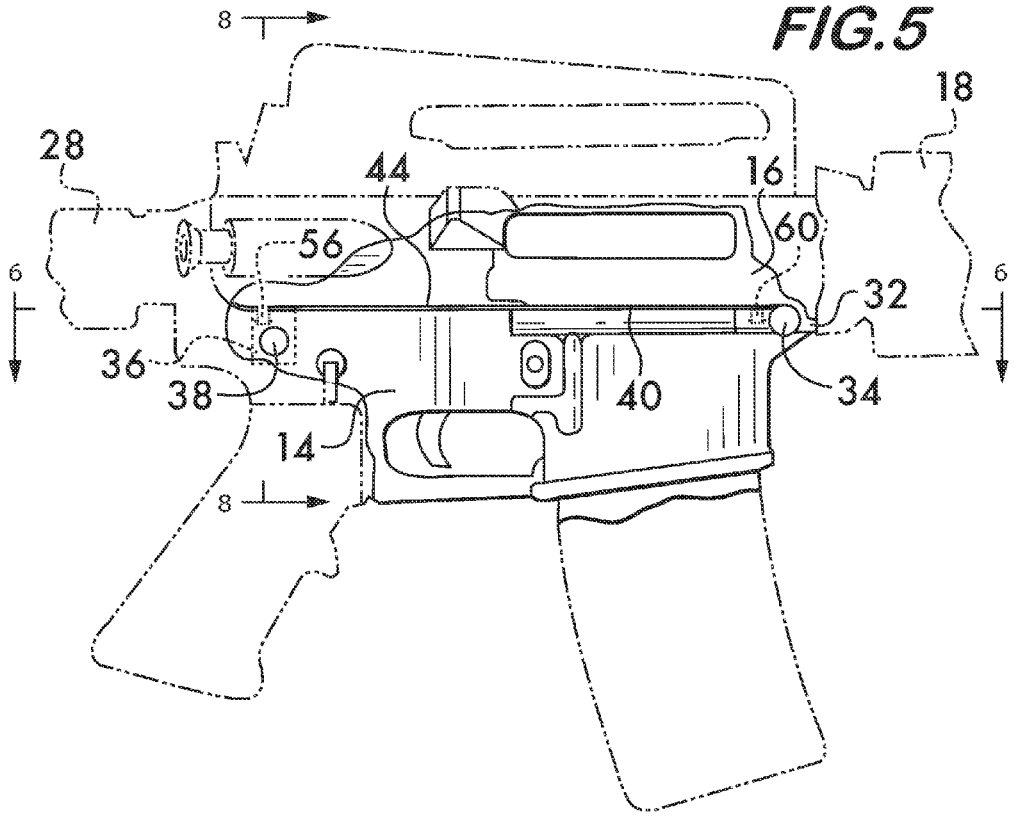
FIG. 5 is a side view of another embodiment of the firearm shown in FIG. 1 depicting the receiver on an enlarged scale.
Figure 6:
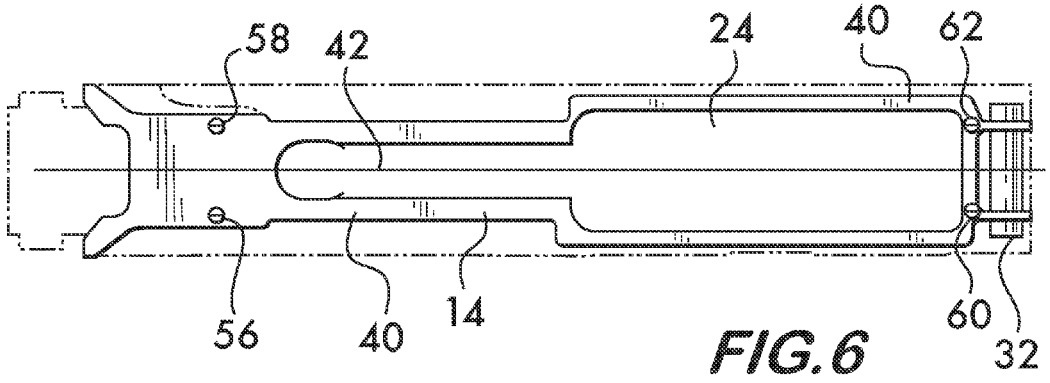
FIG. 6 is a sectional view taken at lines 6-6 in FIG. 5.

As shown in FIGS. 5 and 6, lower receiver portion 14 has an interface surface 40 which extends along opposite sides of a lengthwise extending centerline 42 (see FIG. 6). Similarly, as shown in FIGS. 3 and 4, upper receiver portion 16 has an interface surface 44 extending along opposite sides of the receiver lengthwise extending center line 42 (see FIG. 4). The first interface surface 40 marks the boundary of the lower receiver portion 14, and the second interface surface 44 marks the boundary of the upper receiver portion 16. As illustrated by a comparison of FIGS. 1 and 2, the receiver portions 14 and 16 may be pivotable between a closed configuration (FIG. 1) and an open configuration (FIG. 2). In the closed configuration of FIG. 1 (also FIGS. 3 and 5), the first and second interface surfaces 40 and 44 are in facing relation with one another. In the open configuration of FIG. 2, the first and second interface surfaces 40 and 44 are angularly oriented with respect to one another.

As a result of manufacturing tolerances of the receiver portions 14 and 16 and/or wear of the hinge 32, lug 36 or cross pin 38, there may be play between the upper and lower receiver portions. This play may allow undesired relative movement between the receiver portions when in the closed configuration. To prevent or reduce this play, one or more anti-play buffers are positioned between the respective interface surfaces 40 and 44 of the upper and lower receiver portions 14 and 16. In an example embodiment, shown in FIG. 4, an elastic body 48 is mounted on the interface surface 44 of the upper receiver portion 16 offset from the centerline 42. The elastic body 48 projects from the interface surface 44 and is sized so that it engages the first interface surface 40 of the lower receiver 14 when the receiver portions 14 and 16 are in the closed configuration (see FIG. 3). The elastic body 48 thus engages both receiver portions and inhibits relative motion between them. It may be advantageous to size the elastic body 48 so that it is compressed between the respective interface surfaces 40 and 44 of the lower and upper receiver portions 14 and 16 when the receiver portions are in the closed configuration.

It is further advantageous to mount a second elastic body 50 on the interface surface 44 of the upper receiver portion 16 and offset from the centerline 42 as shown in FIG. 4. Second elastic body 50 also projects from the interface surface 44 and is sized so that it engages the interface surface 40 of the lower receiver 14 when the receiver portions 14 and 16 are in the closed configuration. It may also be advantageous to size the second elastic body 50 so that it is compressed between the respective interface surfaces 40 and 44 of the lower and upper receiver portions 14 and 16 when the receiver portions are in the closed configuration. The second elastic body 50 engages both receiver portions and, in conjunction with the first elastic body 48, inhibits relative motion between the receiver portions. The elastic bodies 48 and 50 in this example are positioned distally to the hinge 32, near the lug 36 (see FIG. 3). Other body positions along the interface surface 44 are also feasible. The use of two elastic bodies in spaced relation on opposite sides of the centerline 42 and distal to the hinge 32 inhibits rotational motion of the receiver portions about the hinge 32 as well as about the centerline 42.

It has been found further advantageous to position additional elastic bodies 52 and 54 between the respective interface surfaces 40 and 44 of the lower and upper receiver portions 14 and 16. As shown in FIG. 4, elastic bodies 52 and 54 are mounted on the interface surface 44 of the upper receiver portion 16. Elastic bodies 52 and 54 are located in spaced relation, offset from and on opposite sides of the centerline 42. Elastic bodies 52 and 54 are positioned proximate to the hinge 32 and project from the interface surface 44 of the upper receiver portion 16 to engage the interface surface 40 of the lower receiver portion 14 when the interface surfaces are in facing relation with one another as shown in FIG. 3.

An increase in shooting accuracy of the firearm is achieved with the use of four elastic bodies positioned as shown in FIG. 4, the bodies being symmetrically positioned on opposite sides of the centerline 42, two bodies 48 and 50 positioned distal to the hinge 32 and two bodies 52 and 54 positioned proximate to the hinge. A further increase in shooting accuracy is observed if the compressive stiffness of the elastic bodies 52 and 54 proximate to the hinge 32 is greater than the compressive stiffness of the elastic bodies 48 and 50 distal to the hinge. The compressive stiffness of the elastic bodies may be tailored, for example, by using elastic material for the elastic bodies 52 and 54 proximate the hinge 32 having a higher durometer than that used for elastic bodies 48 and 50 distal to the hinge. The compressive stiffness is furthermore proportional to the cross sectional area of the bodies, thus, the elastic bodies proximate the hinge can have a larger cross sectional area than those distal to the hinge. Combinations of these parameters can be adjusted to achieve a compressive stiffness which maximizes accuracy for a particular firearm.

In another example embodiment, shown in FIGS. 5 and 6, an elastic body 56 is mounted on the interface surface 40 of the lower receiver portion 14 offset from the centerline 42.

The elastic body 56 projects from the interface surface 40 and is sized so that it engages the interface surface 44 of the upper receiver 16 when the receiver portions 14 and 16 are in the closed configuration (see FIG. 5). The elastic body 56 thus engages both receiver portions and inhibits relative motion between them. It may be advantageous to size the elastic body 56 so that it is compressed between the respective interface surfaces 40 and 44 of the lower and upper receiver portions 14 and 16 when the receiver portions are in the closed configuration.

It is further advantageous to mount a second elastic body 58 on the interface surface 40 of the lower receiver portion 14 and offset from the centerline 42 as shown in FIG. 6. Second elastic body 58 also projects from the interface surface 40 and is sized so that it engages the interface surface 44 of the upper receiver 16 when the receiver portions 14 and 16 are in the closed configuration. It may also be advantageous to size the second elastic body 58 so that it is compressed between the respective interface surfaces 40 and 44 of the lower and upper receiver portions 14 and 16 when the receiver portions are in the closed configuration. The second elastic body 58 engages both receiver portions and, in conjunction with the first elastic body 56, inhibits relative motion between the receiver portions. The elastic bodies 56 and 58 in this example are positioned distally to the hinge 32, near the lug 36 (see FIG. 5). Other body positions along the interface surface 40 are also feasible. The use of two elastic bodies in spaced relation on opposite sides of the centerline 42 and distal to the hinge 32 inhibits rotational motion of the receiver portions about the hinge 32 as well as about the centerline 42.

It has been found further advantageous to position additional elastic bodies 60 and 62 between the respective interface surfaces 40 and 44 of the lower and upper receiver portions 14 and 16. As shown in FIG. 6, elastic bodies 60 and 62 are mounted on the interface surface 40 of the lower receiver portion 14. Elastic bodies 60 and 62 are located in spaced relation, offset from and on opposite sides of the centerline 42. Elastic bodies 60 and 62 are positioned proximate to the hinge 32 and project from the interface surface 40 of the lower receiver portion 14 to engage the interface surface 44 of the upper receiver portion 16 when the interface surfaces are in facing relation with one another as shown in FIG. 5.

An increase in shooting accuracy of the firearm is achieved with the use of four elastic bodies positioned as shown in FIG. 6, the bodies being symmetrically positioned on opposite sides of the centerline 42, two bodies 56 and 58 positioned distal to the hinge 32 and two bodies 60 and 62 positioned proximate to the hinge. A further increase in shooting accuracy is observed if the compressive stiffness of the elastic bodies 60 and 62 proximate to the hinge 32 is greater than the compressive stiffness of the elastic bodies 56 and 58 distal to the hinge. The compressive stiffness of the elastic bodies may be tailored, for example, by using elastic material for the elastic bodies 60 and 62 proximate the hinge 32 having a higher durometer than that used for elastic bodies 56 and 58 distal to the hinge. The compressive stiffness is furthermore proportional to the cross sectional area of the bodies, thus, the elastic bodies proximate the hinge can have a larger cross sectional area than those distal to the hinge. Combinations of these parameters can be adjusted to achieve a compressive stiffness which maximizes accuracy for a particular firearm.

Figure 7:
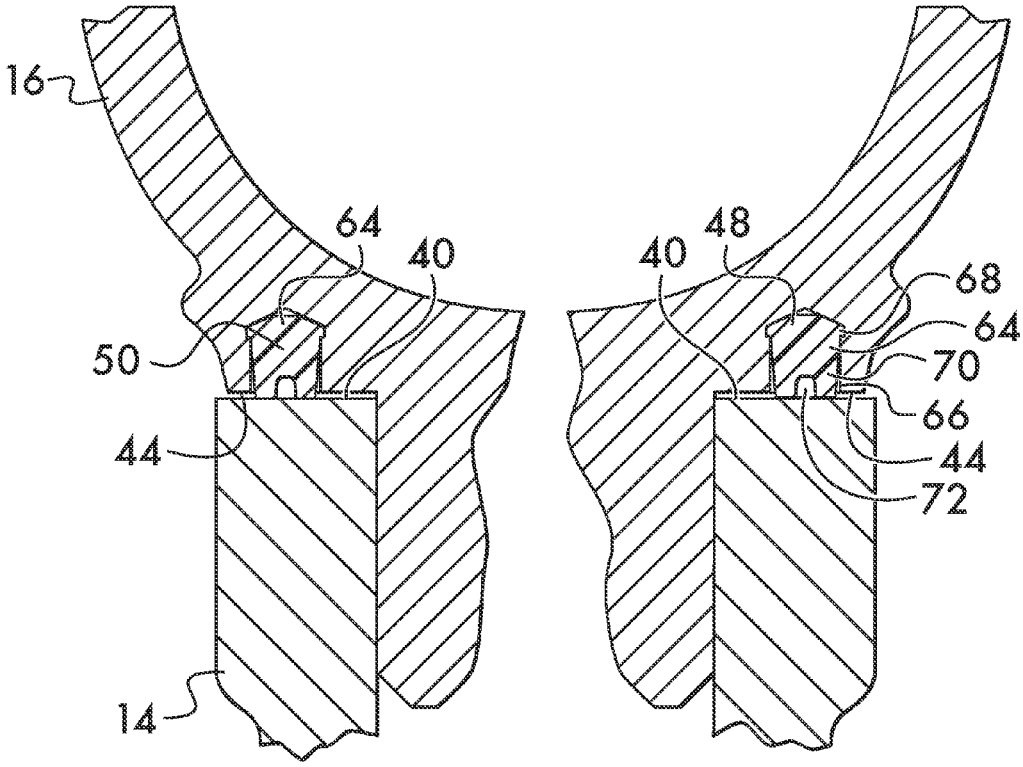
FIG. 7 is a cross sectional view taken at line 7-7 in FIG. 3.
Figure 8:
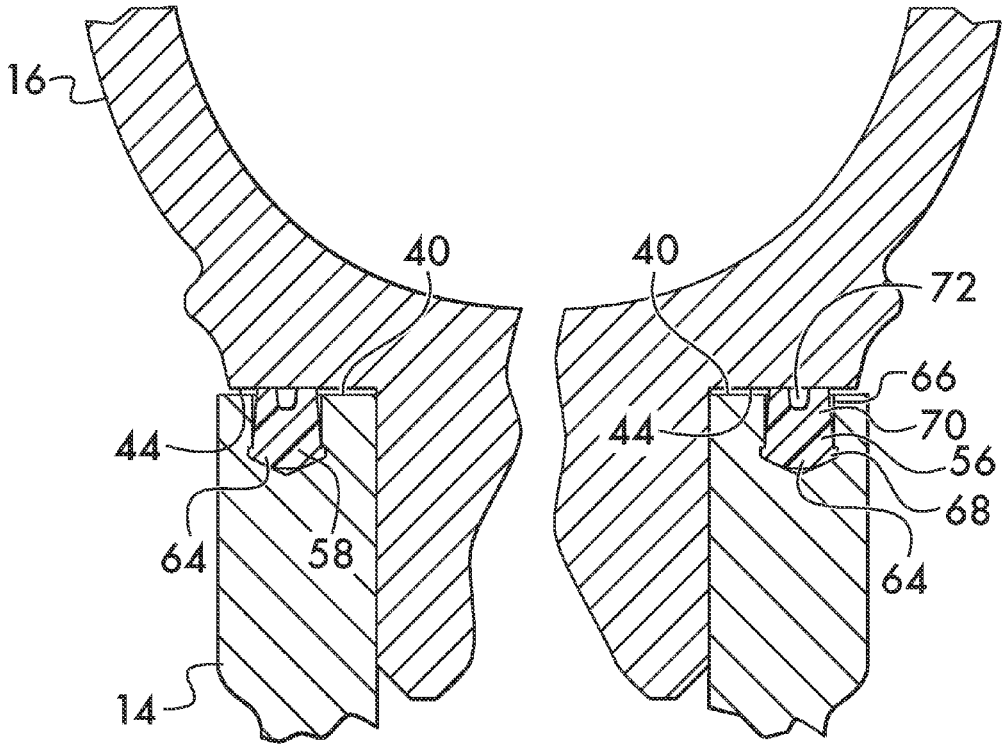
FIG. 8 is a cross sectional view taken at line 8-8 of FIG. 5.

As shown in FIGS. 7 and 8, the elastic bodies may comprise pins 64 mounted within holes 66 machined in the interface surfaces 40 and 44 of the lower and upper receiver portions 14 and 16. Example pins 64, representing elastic bodies 48 and 50, mounted on the interface surface 44 of the upper receiver portion 16, are shown in the sectional view of FIG. 7. Similarly, example pins 64, representing elastic bodies 56 and 58, mounted on the interface surface 40 of the lower receiver portion 14, are shown in the sectional of FIG. 8. In these example embodiments, pin 64 has a bulbous head 68 and a conical body 70 with a void space 72. The head 68 is sized to provide a friction fit within the hole 66 in which it is positioned. The conical body 70 permits radial expansion of the pin within its hole upon compression, and the void space 72 allows the stiffness of the pin to be tuned as desired by varying its size.

It is advantageous to make the pin 64 from resilient, elastic materials such as natural and synthetic rubber compounds, silicone, and polymers such as polytetrafluoroethylene to cite but a few examples. Durometers of about 69A (Shore scale) have been found advantageous for the elastic bodies located distally to the hinge when used in combination with durometers of about 89D for the elastic bodies located proximate to the hinge.

While the elastic bodies 48, 50, 52, 54, 56, 58, 60 and 62 are shown by way of example as being mounted on either the upper or lower receiver portion, it is understood that it is feasible to mount them in any combination on both receiver portions. It is further understood that the elastic bodies may assume a wide range of practical shapes. By way of further example, FIGS. 9 through 12 illustrate elastic bodies formed of elongate strips 72. FIG. 9 shows an elongate strip 72 positioned between interface surfaces 40 and 44 of the lower and upper receiver portions 14 and 16. Elongate strips 72 may be mounted on the interface surface 44 of the upper receiver portion 16 as shown in FIG. 10. Strips 72 may be positioned either or both distally and/or proximate to the hinge 32, and may have different stiffnesses from one another depending upon their position relative to the hinge. Similarly, as shown in FIG. 11, elongate strips 72 may be mounted on the interface surface 40 of the lower receiver portion 14. Again, the strips 72 may be positioned either or both distally and/or proximate to the hinge 32, and may have different stiffnesses from one another depending upon their position relative to the hinge. The strips may be adhesively bonded to the surfaces, for example, using cyanoacrylate adhesives, or, as shown in FIG. 12, each strip 72 may have one or more projections 74 which engage holes 76 in the surfaces 40 and 44 to retain the strips to the receiver portions using friction and/or positive mechanical engagement.

The use of anti-play buffers in receivers reduces or eliminates play between the upper and lower receiver portions and provides a practical, effective and economical solution to this problem. Tests have shown that increased accuracy results from the use of such buffers, and improved perception of quality is also expected to be achieved.

What is claimed is:

1. A receiver for a firearm, said receiver having a lengthwise extending centerline, said receiver comprising:

a lower receiver portion having a first interface surface extending along opposite sides of said centerline;

an upper receiver portion having a second interface surface extending along opposite sides of said centerline;

a hinge positioned between and pivotally attaching said lower and upper receiver portions to one another for positioning said first and second interface surfaces in facing relation with one another;

a first elastic body positioned offset from said centerline between said first and second interface surfaces, said first elastic body being engaged with said upper and lower receiver portions when said interface surfaces are in facing relation with one another.

2. The receiver according to claim 1, further comprising a second elastic body positioned between said first and second interface surfaces and engaged with said upper and lower receiver portions when said interface surfaces are in facing relation with one another.

3. The receiver according to claim 2, wherein said second elastic body is positioned offset from said centerline and on an opposite side thereof from said first elastic body.

4. The receiver according to claim 1, wherein said first elastic body is mounted on said lower receiver portion to project from said first interface surface and engage said second interface surface when said interface surfaces are in facing relation with one another.

5. The receiver according to claim 4, further comprising a second elastic body mounted on said lower receiver portion offset from said centerline to project from said first interface surface and engage said second interface surface when said interface surfaces are in facing relation with one another.

6. The receiver according to claim 5, wherein said first and second elastic bodies comprise pins mounted within respective first and second holes positioned in said first interface surface on opposite sides of said centerline.

7. The receiver according to claim 6, wherein at least one of said pins comprises a bulbous head and a conical body attached to said bulbous head.

8. The receiver according to claim 5, wherein said first and second elastic bodies comprise elongate strips.

9. The receiver according to claim 5, wherein:

said first and second elastic bodies are positioned distally to said hinge.

10. The receiver according to claim 5, wherein:

said first and second elastic bodies are positioned proximate to said hinge.

11. The receiver according to claim 9, further comprising:

a third elastic body positioned between said first and second interface surfaces and engaged with said upper and lower receiver portions when said interface surfaces are in facing relation with one another;

a fourth elastic body positioned between said first and second interface surfaces and engaged with said upper and lower receiver portions when said interface surfaces are in facing relation with one another; and wherein said third and fourth elastic bodies are positioned proximate to said hinge.

12. The receiver according to claim 11, wherein said third and fourth elastic bodies are mounted on said lower receiver portion offset from and on opposite sides of said centerline to project from said first interface surface and engage said second interface surface when said interface surfaces are in facing relation with one another.

13. The receiver according to claim 11, wherein said third and fourth elastic bodies each have a compressive stiffness greater than a compressive stiffness of said first and second elastic bodies.

14. The receiver according to claim 1, wherein said first elastic body is mounted on said upper receiver portion to project from said second interface surface and engage said first interface surface when said interface surfaces are in facing relation with one another.

15. The receiver according to claim 14, further comprising a second elastic body mounted on said upper receiver portion offset from said centerline to project from said second interface surface and engage said first interface surface when said interface surfaces are in facing relation with one another.

16. The receiver according to claim 15, wherein said first and second elastic bodies comprise pins mounted within respective first and second holes positioned in said second interface surface on opposite sides of said centerline.

17. The receiver according to claim 15, wherein at least one of said pins comprises a bulbous head and a conical body attached to said bulbous head.

18. The receiver according to claim 15, wherein said first and second elastic bodies comprise elongate strips.

19. The receiver according to claim 15, wherein:

said first and second elastic bodies are positioned distally to said hinge.

20. The receiver according to claim 15, wherein:

said first and second elastic bodies are positioned proximate to said hinge.

21. The receiver according to claim 19, further comprising:

a third elastic body positioned between said first and second interface surfaces and engaged with said upper and lower receiver portions when said interface surfaces are in facing relation with one another;

a fourth elastic body positioned between said first and second interface surfaces and engaged with said upper and lower receiver portions when said interface surfaces are in facing relation with one another; and wherein said third and fourth elastic bodies are positioned proximate to said hinge.

22. The receiver according to claim 21, wherein said third and fourth elastic bodies are mounted on said upper receiver portion offset from and on opposite sides of said centerline to project from said second interface surface and engage said first interface surface when said interface surfaces are in facing relation with one another.

23. The receiver according to claim 21, wherein said third and fourth elastic bodies each have a compressive stiffness greater than a compressive stiffness of said first and second elastic bodies.

24. A firearm comprising:

a receiver having a lower receiver portion and an upper receiver portion, said receiver having a lengthwise extending centerline;

said lower receiver portion having a first interface surface extending along opposite sides of said centerline;

said upper receiver portion having a second interface surface extending along opposite sides of said centerline;

a hinge positioned between and pivotally attaching said lower and upper receiver portions to one another for positioning said first and second interface surfaces in facing relation with one another;

a first elastic body positioned offset from said centerline between said first and second interface surfaces, said first elastic body being engaged with said upper and lower receiver portions when said interface surfaces are in facing relation with one another.

25. The firearm according to claim 24, further comprising a second elastic body positioned between said first and second interface surfaces and engaged with said upper and lower receiver portions when said interface surfaces are in facing relation with one another.

26. The firearm according to claim 25, wherein said second elastic body is positioned offset from said centerline and on an opposite side thereof from said first elastic body.

27. The firearm according to claim 24, wherein said first elastic body is mounted on said lower receiver portion to project from said first interface surface and engage said second interface surface when said interface surfaces are in facing relation with one another.

28. The firearm according to claim 27, further comprising a second elastic body mounted on said lower receiver portion offset from said centerline to project from said first interface surface and engage said second interface surface when said interface surfaces are in facing relation with one another.

29. The firearm according to claim 28, wherein said first and second elastic bodies comprise pins mounted within respective first and second holes positioned in said first interface surface on opposite sides of said centerline.

30. The firearm according to claim 29, wherein at least one of said pins comprises a bulbous head and a conical body attached to said bulbous head.

31. The firearm according to claim 28, wherein said first and second elastic bodies comprise elongate strips.

32. The firearm according to claim 28, wherein:

said first and second elastic bodies are positioned distally to said hinge.

33. The firearm according to claim 28, wherein:

said first and second elastic bodies are positioned proximate to said hinge.

34. The firearm according to claim 32, further comprising:

a third elastic body positioned between said first and second interface surfaces and engaged with said upper and lower receiver portions when said interface surfaces are in facing relation with one another;

a fourth elastic body positioned between said first and second interface surfaces and engaged with said upper and lower receiver portions when said interface surfaces are in facing relation with one another; and wherein said third and fourth elastic bodies are positioned proximate to said hinge.

35. The firearm according to claim 34, wherein said third and fourth elastic bodies are mounted on said lower receiver portion offset from and on opposite sides of said centerline to project from said first interface surface and engage said second interface surface when said interface surfaces are in facing relation with one another.

36. The firearm according to claim 34, wherein said third and fourth elastic bodies each have a compressive stiffness greater than a compressive stiffness of said first and second elastic bodies.

37. The firearm according to claim 24, wherein said first elastic body is mounted on said upper receiver portion to project from said second interface surface and engage said first interface surface when said interface surfaces are in facing relation with one another.

38. The firearm according to claim 37, further comprising a second elastic body mounted on said upper receiver portion offset from said centerline to project from said second interface surface and engage said first interface surface when said interface surfaces are in facing relation with one another.

39. The firearm according to claim 38, wherein said first and second elastic bodies comprise pins mounted within respective first and second holes positioned in said second interface surface on opposite sides of said centerline.

40. The firearm according to claim 39, wherein at least one of said pins comprises a bulbous head and a conical body attached to said bulbous head.

41. The firearm according to claim 38, wherein said first and second elastic bodies comprise elongate strips.

42. The firearm according to claim 38, wherein:

said first and second elastic bodies are positioned distally to said hinge.

43. The firearm according to claim 38, wherein:

said first and second elastic bodies are positioned proximate to said hinge.

44. The firearm according to claim 42, further comprising:

a third elastic body positioned between said first and second interface surfaces and engaged with said upper and lower receiver portions when said interface surfaces are in facing relation with one another;

a fourth elastic body positioned between said first and second interface surfaces and engaged with said upper and lower receiver portions when said interface surfaces are in facing relation with one another; and wherein said third and fourth elastic bodies are positioned proximate to said hinge.

45. The firearm according to claim 44, wherein said third and fourth elastic bodies are mounted on said upper receiver portion offset from and on opposite sides of said centerline to project from said second interface surface and engage said first interface surface when said interface surfaces are in facing relation with one another.

46. The firearm according to claim 44, wherein said third and fourth elastic bodies each have a compressive stiffness greater than a compressive stiffness of said first and second elastic bodies.

* * * * *